US005320044A

United States Patent [19]

Walters

[11] Patent Number: 5,320,044

[45] Date of Patent: Jun. 14, 1994

[54] THREE RADII SHAPED CHARGE LINER

[75] Inventor: William P. Walters, Elkton, Md.

[73] Assignee: The United States of America as represented by the Secretary of the Army, Washington, D.C.

[21] Appl. No.: 788,612

[22] Filed: Jun. 17, 1985

[51] Int. Cl.[5] ..... F42B 12/10

[52] U.S. Cl. ..... 102/475; 102/306

[58] Field of Search ..... 102/476, 306–310

[56] References Cited

U.S. PATENT DOCUMENTS

| | | | |
|---|---|---|---|
| 2,796,833 | 6/1957 | Sweetman | 102/306 |
| 2,856,850 | 10/1958 | Church et al. . | |
| 3,077,834 | 2/1963 | Caldwell . | |
| 3,176,613 | 4/1965 | Godfrey et al. | 102/306 |
| 3,269,467 | 8/1966 | Bell | 102/310 |
| 3,477,372 | 11/1969 | McFerrin et al. . | |
| 3,478,685 | 11/1969 | Thomanek et al. . | |
| 3,732,816 | 5/1973 | Muller | 102/306 |
| 3,875,862 | 4/1975 | Fisher et al. | 102/476 |
| 3,913,488 | 10/1975 | Dunetz et al. | 102/501 |

OTHER PUBLICATIONS

*Secrets of the Shaped Charge* Ardnance, Jul.–Aug. 1948, pp. 49–51.

*Primary Examiner*—Harold J. Tudc.

*Attorney, Agent, or Firm*—Saul Elbaum; Guy M. Miller; Thomas McDonald

[57] ABSTRACT

A novel warhead employing a unique shaped charge liner design is disclosed. A particular construction of the liner is described whereby the fabrication process uses three radii of curvature to generate an arcuate design which is convex when viewed from the open end. This liner design is capable of producing two distinct jets; a front or precursor jet consisting of small diameter particles traveling faster than a secondary or main jet and consists of larger diameter particles.

2 Claims, 2 Drawing Sheets

THREE RADII SHAPED CHARGE LINER

GOVERNMENTAL INTEREST

The invention described herein may be manufactured used and licensed by or for the Government for Governmental purposes without payment to me of any royalties thereon.

BACKGROUND AND FIELD OF THE INVENTION

The present invention relates in general to explosive devices and in particular, to a novel shaped charge liner design capable of producing two distinct jets.

It is possible to utilize specially shaped charge liners in explosive devices, particularly oil well perforators, anti-tank weapons, mines, and the like. Shaped-charge liners, upon detonation of the explosive device, collapse to form a metallic and continuous jet. This jet will stretch, due to the velocity gradient imparted to the jet during the collapse process, and eventually particulate into a series of particles. The kinematic properties desirable for the jet depend upon the target the jet is designed to defeat. For optimum performance against advanced armor targets, it is proposed to produce two jets, i.e., an early lead or precursor jet followed by a slower main jet. The main jet would have a larger diameter than the precursor jet. To construct a device to produce a series of such jets, as well as to regulate the spacing between each, the length, duration, temperature or velocity gradient of each jet, as well as methodology to remove difficult targets such as seekers or guidance packages, are difficult and most desirable objectives of this invention.

BRIEF SUMMARY OF THE INVENTION

This design utilizes a shaped charge with a highly unusual liner. A hemispherical shaped liner has its center built up from the open end site. The shape is quite unusual; it is such that it is described as three different radius hemispherical shapes converging at the central pole areas.

The three radii liner design also provides two distinct jets, quite useful in removing seekers or guidance packages, and very effective against advanced targets. The three radii 1 i her uses a totally different physical concept to achieve the two separable jets than any other known liner design. Certain other great advantages include that the design utilizes a smaller liner (altitude) for the same result, necessitating less explosives overhead to accomplish the same results, giving also less packing space, volume, weight, and expense in fabrication.

OBJECTS OF THE INVENTION

Accordingly, it is an object of this invention to provide a more powerful target penetrator for use against advanced armor.

Another object is to provide a smaller warhead device for defeating advanced armor.

A yet further object is to provide an adjustable, double jet, increased velocity penetration device for use against armor, in a smaller warhead.

The foregoing and other objects and advantages of the invention will appear from the following description. In the description reference is made to the accompanying drawings which form a part hereof, and in which there is shown by way of illustration and not of limitation a preferred embodiment. Such description does not represent the full extent of the invention, but rather the invention may be employed in different arrangements according to the breadth of the invention.

LIST OF FIGURES

DETAILED DESCRIPTION OF THE INVENTION

Figure 1:
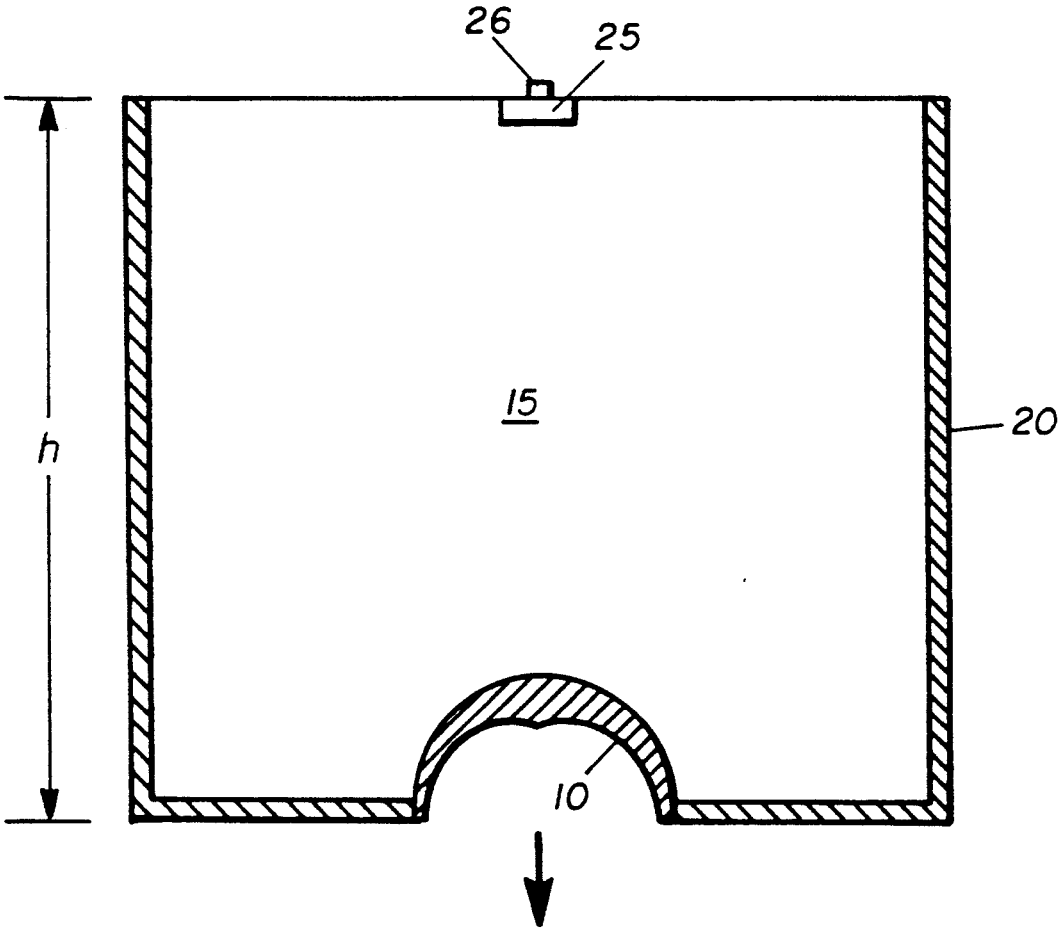
FIG. 1 shows a cross-sectional warhead according to the invention.

In FIG. 1, a cross-section of a warhead according to this invention is shown. It depicts a unique liner 10 encased in a body 20 and loaded with a high explosive 15, and includes a booster 25 and detonator 26, assembly. The warhead according to this invention is capable of delivering two successive, independent jets of high temperature metal capable of penetrating thick armor in a one-two punch, type attack. The direction of jet formation is given by the arrow. Attention is turned to the liner where it will be noted there is a thickened solid polar region thickened from the bottom, concave side only of the otherwise near hemisphere shape. The top explosive side of the hemisphere is smooth; no additional geometrical shaped contrivances being attached there. In operation, it is hypothesized that after detonation of the high explosive, the liner begins to collapse. Because of thickness of the pole region however, the liner is unable to invert or turn "inside out" from the pole in accordance with the collapse of a point initiated denotation of a uniform wall thickness hemispherical liner. Thus, the liner material begins to jet from points A1 and A2 in FIG. 2 or 3, and moves around the thickened pole region. Thus, the thickened pole region acts like a slide plane or slide surface allowing jet material to flow around it. For this reason, the thickened pole area is tapered into a conical geometric form at its extremities. The portion of the jet formed by "sliding" over the thickened pole proceeds at a faster velocity than for a uniform wall thickness liner but particulates (breaks up into particles) early. This produces the high speed precursor jet. Later, the thickened pole region begins to move forward, and is joined by the remainder of the collapsing liner material. Then the remainder of the formation process proceeds as that of a hemispherical liner and the main jet is formed resulting in larger diameter particles traveling slower than any of the particles of the precursor jet. The spacing between the two jets can be regulated by altering the material, wall thickness, or by tapering the wall of, the main hemispherical liner. The spacing between the two jets can also be controlled by varying the height and diameter of the thickened pole region. An optimum diameter of the thickened pole region is believed to be 20 to 40 percent of the main liner diameter, The optimum height of the thickened pole region is believed to be 5 to 15 percent of the liner diameter. It is believed the inventive concept herein may also be applied to any arcuate shaped charge liner shape including, but not limited to, hemispherical liners, conical liners, tapered hemispherical liners, truncated hemispherical liners, Misnay-Chardin liners, self-forging fragments, ballistic discs, and the like. The three radii shaped charge liner has a smaller total altitude or height than other cone type designs that require an attachment above a hemisphere, for example, for trying to produce two successive jets. Because nothing is added above the hemisphere but only below it, the liner height is kept lower. Thus, a shorter liner and hence a smaller head-height, or height of explosve, can be used. Beside the obvious economies in space, weight, and use of less explosive materials, there is a larger impact with this type of warhead, per unit of explosive.

Figure 3:
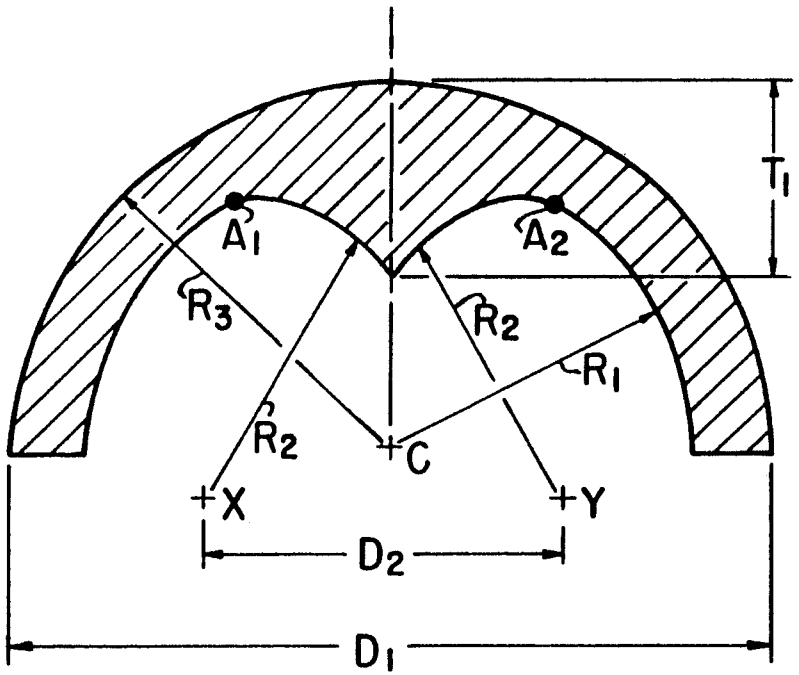
FIG. 3 shows an alternate cross-section of the liner shown in FIG. 2.
Figure 2:
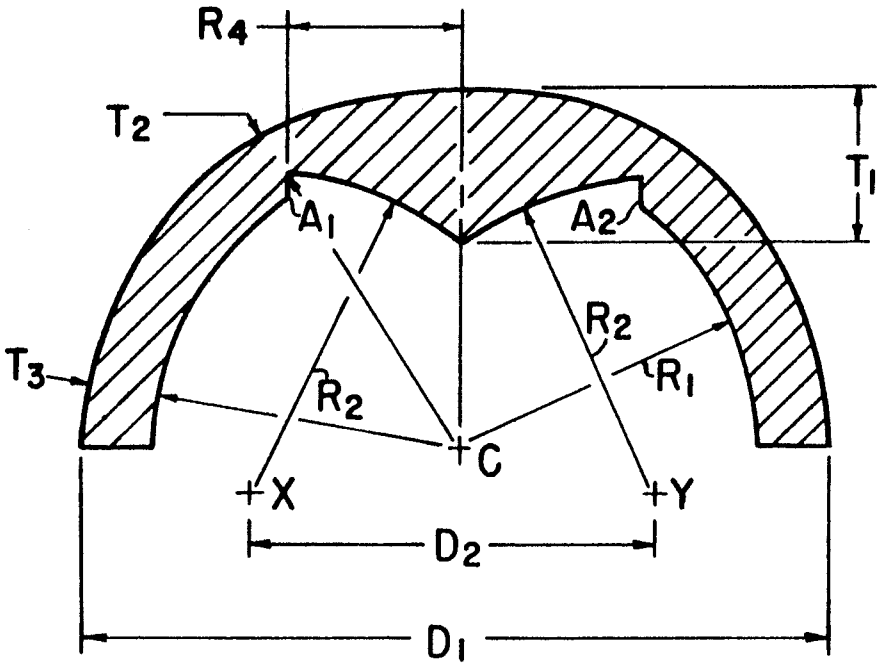
FIG. 2 shows a cross-section of the liner of FIG. 1.

FIGS. 2 and 3 show a more detailed cross-section of the liner 10. The liner is hemispherical shaped, except the area between the points A1 and A2, where an inwardly arched substantially conical shaped section is found. While the hemisphere (Center C, radius $R_1$) is generally a thickness of $T_3$, at these points A1 & A2, a lesser thickness of $T_2$ may appear. This is to enable these points to break away first, as was described. It is noted that at the apex, the thickness $T_1$ of the conical section, is a thickness greater than the general thickness $T_3$ of the hemisphere. The cross-section of the conical region is described by reference to equal radius arcs $R_2$, symmetrically centered at points X and Y respectively, said arcs or arc, revolved about the center line 360°. As was mentioned earlier, an optimum diameter of the pole regions circular, $D_2$, is 20 to 40 percent of the main liner diameter, $D_1$. The radius of the pole region's circular base is designated as $R_4$. The optimum height, $D_3$, of the region is 5 to 15 percent of $D_1$. Typical scaled values for these dimensions in inches could be $D_1=5.000$, $D_2\pm1.720\pm0.002$, $T_1=0.285$ $\pm0.001$. $R_1=2.420\pm0.001$, $R_2=3.000\pm0.001$, $T_3=0.080$, $T_2=0.025$. The casing 20 in FIG. 1, could be ¼" thick aluminum with height, h, of 7½", as was done in one experiment with 75/25 OCTOL high explosive and in which by flash radiograph data, it was determined that the lead element of the precursor jet was travelling at about 6 Km/sec and that the lead particle of the main jet was travelling at about 4.7 Kin/sec. The device had verified performance against advanced armors. A jet with a lead particle travelling at only 3.9 Km/sec by contrast, could be obtained with a plain hemisphere unmodified by a polar region according to this invention, with a similar thicknesses: $T_3=0.080''$ and diameter $D_1=5.0''$. Various physical changes to the device can be made, with a corresponding change in the kinematic properties of the jet. These include altering the liner geometry, conical or hemispherical liners, altering the liner base diameter $D_1$ or cones apex angle, altering the liner wall thickness $T_3$, or tapering the liner wall thickness in various regions, altering the type and amount of the high explosive, its geometry or mode of initiation, the use of a casing or confining body around the explosive, altering the casing material, thickness and geometry, and altering the liner material or materials. It is known that the depth of penetration of an armor target is proportional to the length of the jet, and velocity gradient of the jet. One way to get a faster jet would be with a thinner walled liner, though less mass would be jetting. A narrower pole ($D_2$) would produce a faster jet as well. More time between jets might be obtained by making the liner thickness $T_3$ thicker in proportion to the dimensions of the polar region presently shown. Thinning the liner wall at points A1, A2 tends to lengthen the time between jets, other factors being equal. Increasing dimensions D2, $T_1$, would tend to slow the first jet. Also of note, the thickened pole region need not be a conical geometric form at its extremities but may be any arcuate shape.

While the invention has been described with reference to one particular embodiment or embodiments, the invention also includes all variations, substitutions and modifications as will be obvious to those skilled in the art within the spirit and scope of the invention, its description or claims.

What is claimed is:

1. A warhead generating two distinct jets comprising:

a casing;

an explosive charge in said casing having a hemispherical downwardly opening concavity forming a concave surface and said explosive charge, the hemispherical concave surface substantially concentric with a central vertical axis of said explosive charge and ending on a plane substantially perpendicular with said vertical axis;

a one piece liner having a hemispherical convex surface, with a radius $R_3$ extending from a center point defined by the intersection of said plane and said central vertical axis, in contact with the concave surface of said explosive charge and a downwardly opening cavity surface, said liner cavity surface having a polar region formed in the shape of an inwardly arced substantially conical section having its central axis in substantially concentric alignment with said vertical axis, the conical section's inward arc extending from a downwardly pointing apex to a circular base having a radius $R_4$, where $R_4$ is about 20 to 40 percent the distance of $R_3$, the radial thickness of said liner at the apex of the conical section being T1 and the radial thickness of said liner at the circular base being T2, said liner cavity surface further formed by a second arc extending from said plane to a position radially aligned with the circular base of the inwardly arched substantially conical section and having a radius $R_1$ extending from said center point, where $R_1<R_3$, and rotating the second arc 360° about said vertical axis, the radial thickness of said liner at positions on the surface generated by the second arc being T3 where $T1>T3\geqq T2$; and means for detonating said explosive charge, whereby detonation of said explosive charge causes said one piece liner to initiate a first high speed precurser jet formed at the circular base of the inwardly arched substantially conical section trailed by a second slower jet formed by the inwardly arched substantially conical section.

2. The warhead of claim 1 wherein the radial thickness $T_1$ is about 10 to 30 percent the distance of $R_3$.

* * * * *